US005257790A

United States Patent [19]

Meadows

[11] Patent Number: 5,257,790

[45] Date of Patent: Nov. 2, 1993

[54] COMBINATION TARGET

[76] Inventor: Dan R. Meadows, 6710 High Point Rd., Douglasville, Ga. 30134

[21] Appl. No.: 848,717

[22] Filed: Mar. 9, 1992

[51] Int. Cl.[5] ..... F41J 5/18

[52] U.S. Cl. ..... 273/389; 273/390

[58] Field of Search ..... 273/389, 390, 391, 392, 273/378, 379, 382, 383, 385, 386, 387

[56] References Cited

U.S. PATENT DOCUMENTS

| | | | |
|---|---|---|---|
| 1,949,554 | 3/1934 | Winning et al. | 273/383 |
| 2,000,368 | 5/1935 | Winning et al. | 273/383 |
| 2,232,743 | 2/1941 | Swenson | 273/378 X |

*Primary Examiner*—William H. Grieb
*Attorney, Agent, or Firm*—Eric R. Katz

[57] ABSTRACT

A combination target for use in competitive shooting tournaments includes primary and secondary targets which are reliably presented to a shooter in sequence as well as a signalling arrangement which signals a hit only after both targets have fallen to a scoring position. The combination target includes a face plate including at least first and second apertures, a primary target and a secondary target being positioned behind the face plate and respectively at the first and second apertures. A target protector plate is further provided for protecting the secondary target from being struck by a projectile until the primary target has been knocked down to a scoring position. The target protector plate is pivotally mounted so as to be movable, by gravity, from a first position covering the second aperture to a second position uncovering the second aperture. Also included is a target protector plate mechanism for holding the target protector plate at the first position until the primary target has been knocked down and for releasing the protector plate from the first position to uncover the second aperture when the primary target has fallen to the scoring position. A signalling arrangement is further included for providing an indication or signal when both the primary and secondary targets have fallen to the scoring position, the signalling arrangement being movable between a hidden position and a signalling position.

13 Claims, 6 Drawing Sheets

COMBINATION TARGET

BACKGROUND OF THE INVENTION

1. Field of the Invention:

The present invention generally relates to targets for use in competitive shooting tournaments, and more particularly, to a combination target wherein primary and secondary targets thereof are reliably presented to a shooter in sequence and to a signalling arrangement wherein the signalling of a score is only provided after a target has been committed to fall, by gravity, to a scoring position 2. Background In competitive shooting tournaments, each individual participant or team scores points by knocking down targets in a wide variety of shooting events which each test different skills of the marksman FIG. 1 illustrates a typical shooting event in which a shooter 11 shoots at, for example, single targets 13 of uniform size positioned at different distances from the firing line. Shooter 11 is awarded points based on the number of targets struck and knocked down, typically in a given time period. The total points awarded for all events of the tournament determines the standing of each participant or team.

In order to test the different skills of the competitors in the tournament, it is common to vary the type and size of the targets as well as their configuration. For example, a target used may comprise a single target, as shown in FIG. 1, wherein a score is credited when it is knocked down to the scoring position. Alternatively, the target can comprise a combination target including at least primary and secondary targets which both must be struck, often in sequence, before a score is credited to a shooter.

With the combination target, a problem arises if the secondary target is accidently knocked down before the primary target has been struck, particularly when a signalling arrangement for indicating the crediting of a score is triggered by the falling of the secondary target. In such an case, the shooter may be credited with a hit even though the primary target has not been struck or alternatively, the shooter is disqualified from using the combination target to score points.

A further deficiency of known targets is that when the signalling arrangement is triggered by the falling of the target, a grazing strike which moves the target, but does not cause the target to fall to the scoring position, can trigger the signalling arrangement thereby indicating a hit which does not qualify as a score.

SUMMARY OF THE INVENTION

Accordingly, it is an object of the present invention to provide a combination target wherein a secondary target is reliably protected from being struck by a projectile until a primary target has been knocked down.

It is a further object of the present invention to provide a combination target wherein the secondary target is presented to the shooter only after the primary target has fallen to a scoring position.

It is a yet another object of the present invention to provide a signalling arrangement for signalling when a target has been knocked down to the scoring position, the signalling arrangement being triggered only after the target has been committed, by gravity, to fall to the scoring position.

One particularly advantageous feature of the present invention is that there is provided an arrangement for adjusting a substantially vertical position of a target at the ready position so as to vary the amount of force of a striking projectile necessary for knocking down the targets.

Yet another advantageous feature of the present invention is that the targets form a zig zag pattern thereby increasing the difficulty of the shooter in sighting the targets so as to better test the skills of the marksman.

These and other objects, advantages and features of the present invention are achieved, according to one embodiment thereof, by a combination target having a face plate including at least first and second apertures. A primary target and a secondary target are positioned behind the face plate and respectively at the first and second apertures. A target protector plate is further provided for protecting the secondary target from being struck by a projectile until the primary target has been knocked down to a scoring position. The target protector plate is pivotally mounted so as to be movable, by gravity, from a first position covering the second aperture to a second position uncovering the second aperture.

The combination target also includes a target protector plate mechanism for holding the target protector plate at the first position until the primary target has been knocked down and for releasing the protector plate from the first position to uncover the second aperture when the primary target has fallen to the scoring position. A signalling arrangement is further included for providing an indication or signal when both the primary and secondary targets have fallen to the scoring position, the signalling arrangement being movable between a hidden position and a signalling position.

More particularly, the target protector plate mechanism comprises a first member pivotally mounted to a main shaft for movement between a hold position and a release position, a holding pin attached to the first member for engaging a hole in the target protector plate when the first member is at the hold position and the target protector plate is at the first position and a second member rigidly attached to the first member. The second member of the target protector plate mechanism is positioned adjacent to the primary target so that, when the primary target is struck and falls from the ready position to the scoring position, the primary target strikes the second member so that the first member is pivoted from the hold position to the release position thereby withdrawing the holding pin from the hole in the protector plate and releasing the protector plate from the first position.

According to a further embodiment of the present invention, which is applicable to both single and combination targets, the signalling arrangement comprises a flag mounted by a flag shaft to a segment of angle iron which is pivotally mounted to a substantially vertical pivot axis, the segment of angle iron being also movable along the substantially vertical pivot axis. The target, which is positioned adjacent to the signalling arrangement, includes a trigger which moves the signalling arrangement to the signalling position when the secondary target is knocked down to the scoring position.

According to preferred embodiments of the present invention, the trigger comprises a trigger shaft rigidly attached to the target for pivotal movement therewith, the trigger shaft engaging a bottom edge of the segment of angle iron only after the target is hit by a projectile and is committed to fall and the signalling arrangement is at the hidden position. The trigger shaft has a trigger pin at a distal end thereof for engaging a side of the segment of angle iron as the trigger shaft is pivoted with the secondary target during movement thereof from the ready to the scoring position. In operation, when the target is struck and is committed, by gravity, to fall to the scoring position, the trigger shaft first lifts and then pivots the segment of angle iron, and as the secondary target continues to move towards the scoring position, the trigger pin engages the side of the segment of angle iron and continues to pivot the segment of angle until the signal flag is swung out to a side of the face plate and occupies the signalling position.

DETAILED DESCRIPTION OF THE PREFERRED EMBODIMENT(S)

Figure 1:
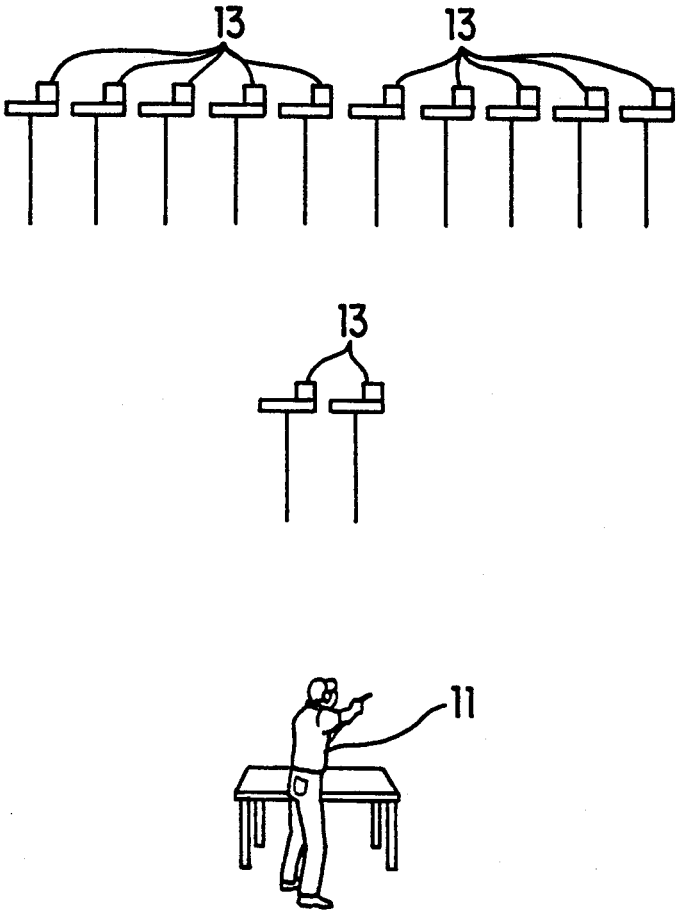
FIG. 1 (PRIOR ART)
FIG. 1 illustrates a known single target configuration for use in one type of shooting event of a competitive shooting tournament.
Figure 2B:
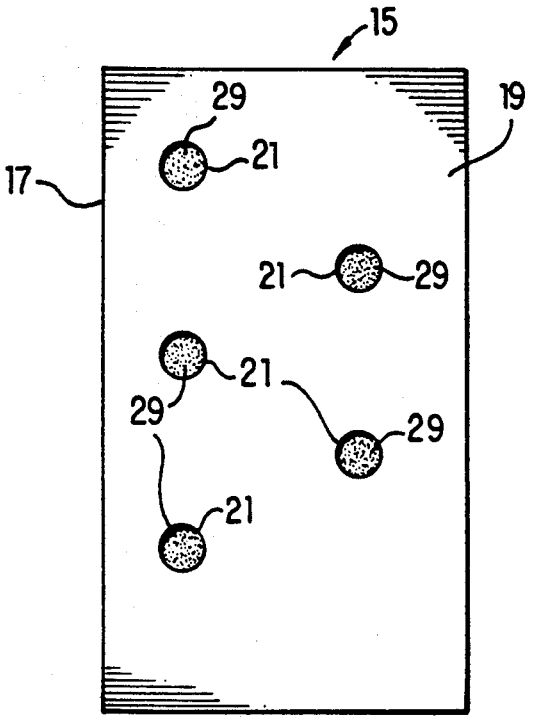
FIGS. 2A–2C are front, planar views of a combination target in different stages of being struck, according to one embodiment of the present invention.
Figure 2C:
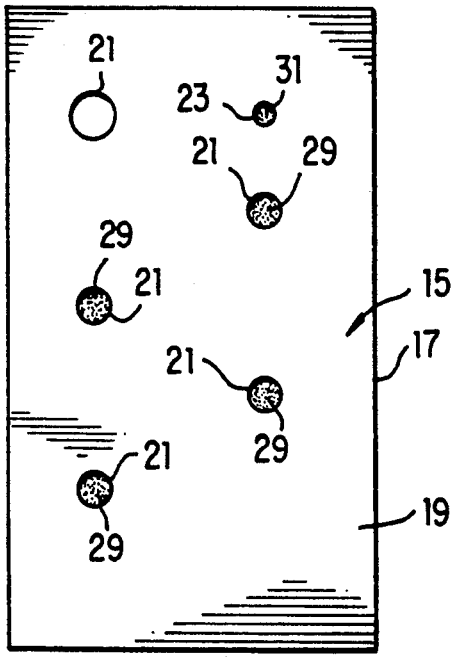
Figure 2A:
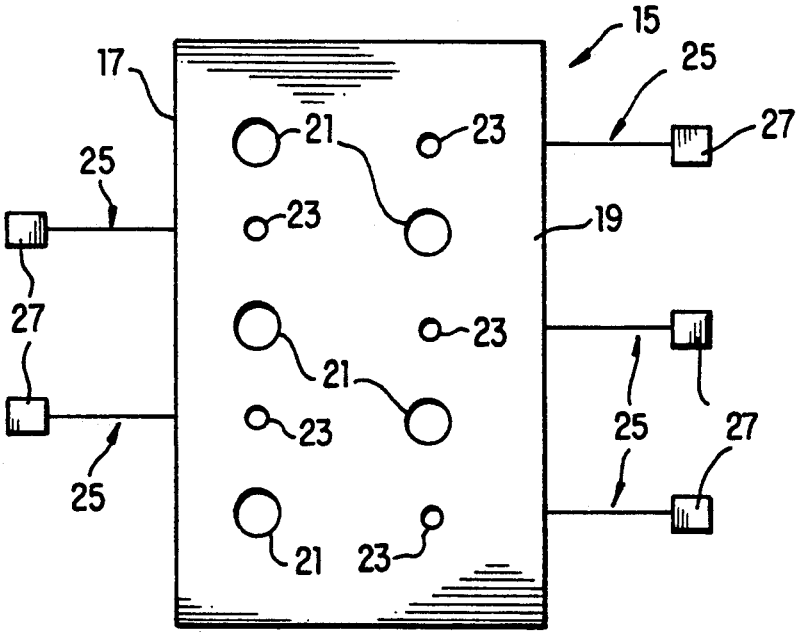

Referring to FIG. 2A, one embodiment of the combination target of the present invention is illustrated, generally at 15, the target 15 being depicted with all the targets (not shown) knocked down to the scoring position. The target 15 comprises a face plate 17 having a front surface 19 which faces a shooter, the face plate 17 having at least a first aperture 21 and a second aperture 23 provided therethrough.

In the embodiment of FIG. 2A, the at least first and second apertures 21, 23 respectively comprise first and second sets of apertures, each set of apertures having a different size and each set respectively forming a zig zag pattern so as to require the shooter to change both the elevation and horizontal position of the firearm during aiming.

Also shown in FIG. 2A are the signal means, generally indicated at 25, which are depicted at in the signalling position. According to a further embodiment of the present invention, the signal means, as will more fully be described with respect to FIGS. 3A–3C, includes a signal flag 27 which moves from a hidden position behind the face plate 17 to the signalling position when a target (not shown) is knocked down to the scoring position. In should to clear, that the signal means 25 is applicable to both single and combination targets.

FIG. 2B illustrates the combination target 15 at it would appear initially to a shooter at the beginning of a shooting event. In this regard, all that the shooter would see is each primary target 29 positioned behind the associated first aperture 21 because the second aperture 23 is covered by a protector plate (not shown) so that the secondary target (not shown) is hidden from view. Preferably, the protector plate and face plate 17 are painted the same color so as to be indistinguishable to the shooter, each of the primary targets 29 being painted a different color from the face plate 17 so as to stand out therefrom.

FIG. 2C illustrates the combination target 15 with the primary target (not shown) behind the first aperture 21 at the upper left hand corner, as viewed by the shooter, in the knocked down, scoring position. As a result, the protector plate (not shown) for the adjacent second aperture 23 has been removed so as to reveal a secondary target 31 therebehind.

As with the primary targets 29, each of the secondary targets 31 are painted a different color from the face plate 17 so as to stand out therefrom. Because the secondary target 31 has not been stuck in FIG. 2C, the signalling means (not shown) has not yet been deployed to signal the scoring of a combination hit, i.e., adjacent primary and secondary targets 21, 23 both being knocked down as shown in FIG. 2A.

Figure 3A:
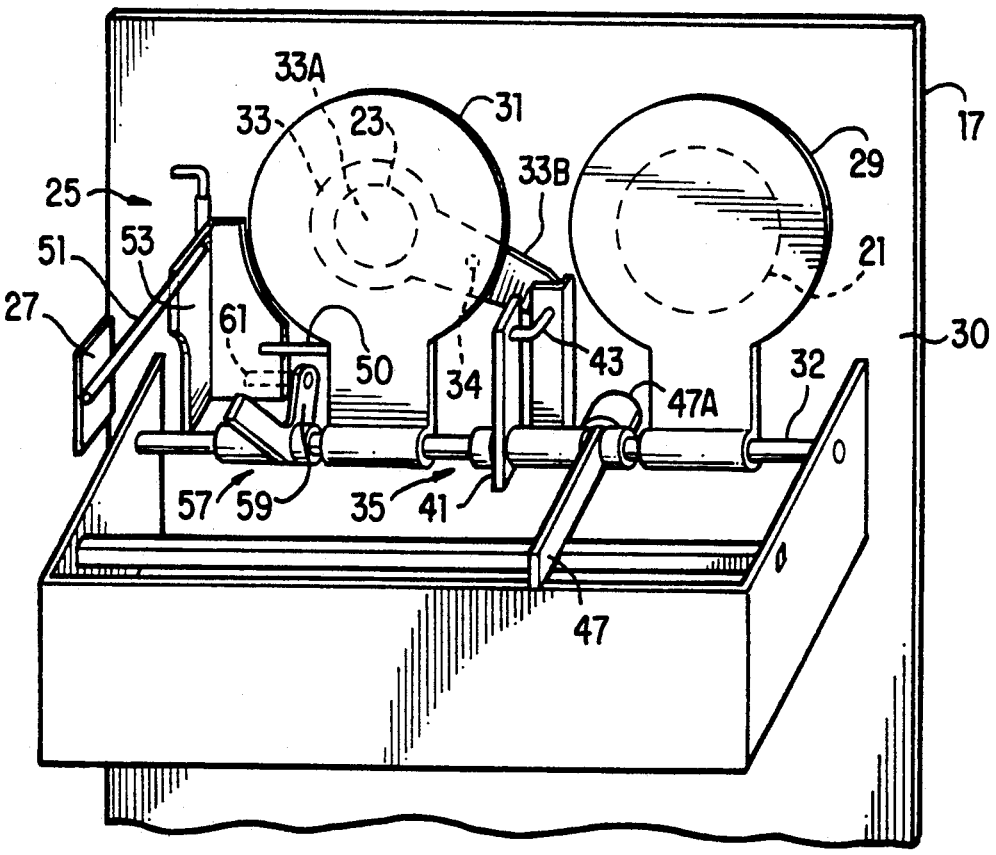
FIGS. 3A–3C are detailed perspective views of the combination target of FIGS. 2A–2C illustrating the operation thereof, particularly the target protector plate mechanism and the signalling arrangement.

Referring to FIG. 3A, the back side of the combination target 15 is illustrated with both the primary and secondary targets 29, 31 shown in a substantially vertical, ready position. Both the primary and secondary targets 29, 31 are pivotally mounted, for example, on a main shaft 32 for movement between a substantially vertical, ready position, adjacent the associated aperture, and a knocked down, scoring position.

As best seen in FIG. 3A, the combination target 15 further includes, at a back surface 30 of the face plate 17, a target protector plate 33 for protecting the secondary target 31 from being struck by a projectile until the primary target 29 has fallen to the knocked down, scoring position. The target protector plate 33 is pivotally mounted at a pivot axis 34 so as to be movable, by gravity, from a first position (as shown in FIG. 3A) covering the associated second aperture 23 to a second position (as shown in FIGS. 3B–3C) uncovering the second aperture 23 and exposing the secondary target 31.

Figure 3B:
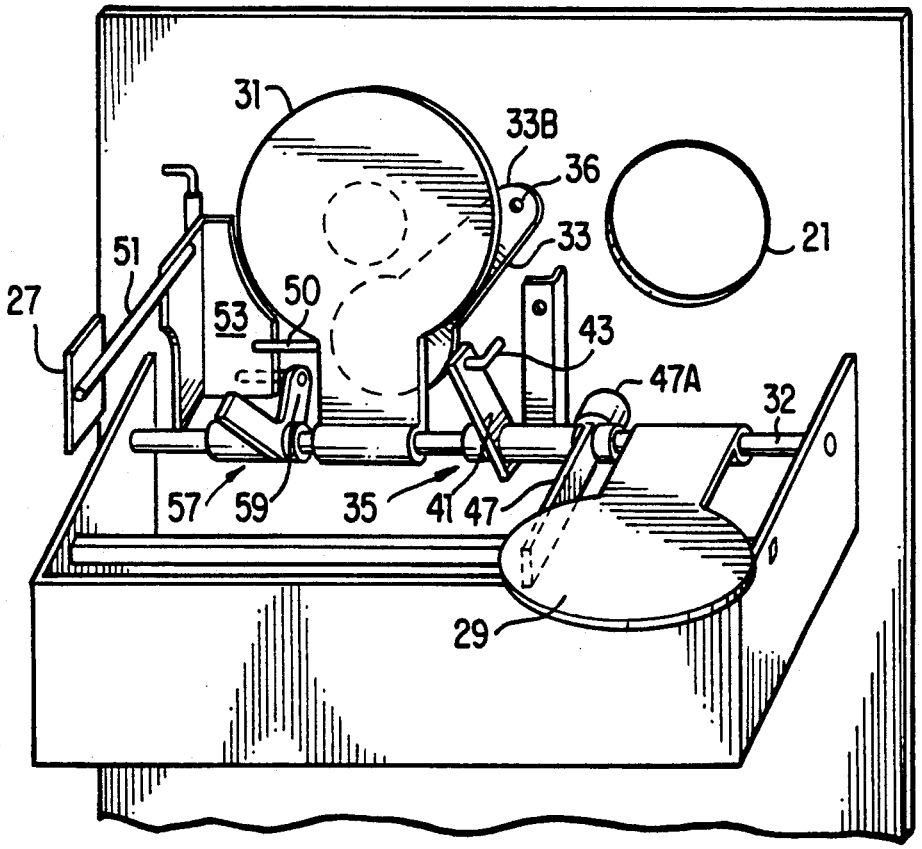

The target protector plate 33 preferably comprises a paddle shaped plate having a broad flattened blade 33A for covering the second aperture 23 and a shank 33B extending therefrom which is provided with a hole 36 as best seen in FIG. 3B. In order to better pivot the protector plate 33 upon release, the pivot point of the plate 33 is, for example, off-set upwards from a center line A of the plate 33 as best seen in FIG. 3C.

The combination target 15 also includes a target protector plate mechanism, generally indicated at 35, for holding the target protector plate 33 at the first position until the primary target 23 has been struck by a projectile and has fallen to a scoring position as shown in FIG. 3B. As will be more fully described hereinafter, as the primary target 23 is falling to the scoring position, the mechanism 35 releases the protector plate 33 so that the plate 33 pivots, under the influence of gravity, and exposes the second aperture 23.

Figure 3C:
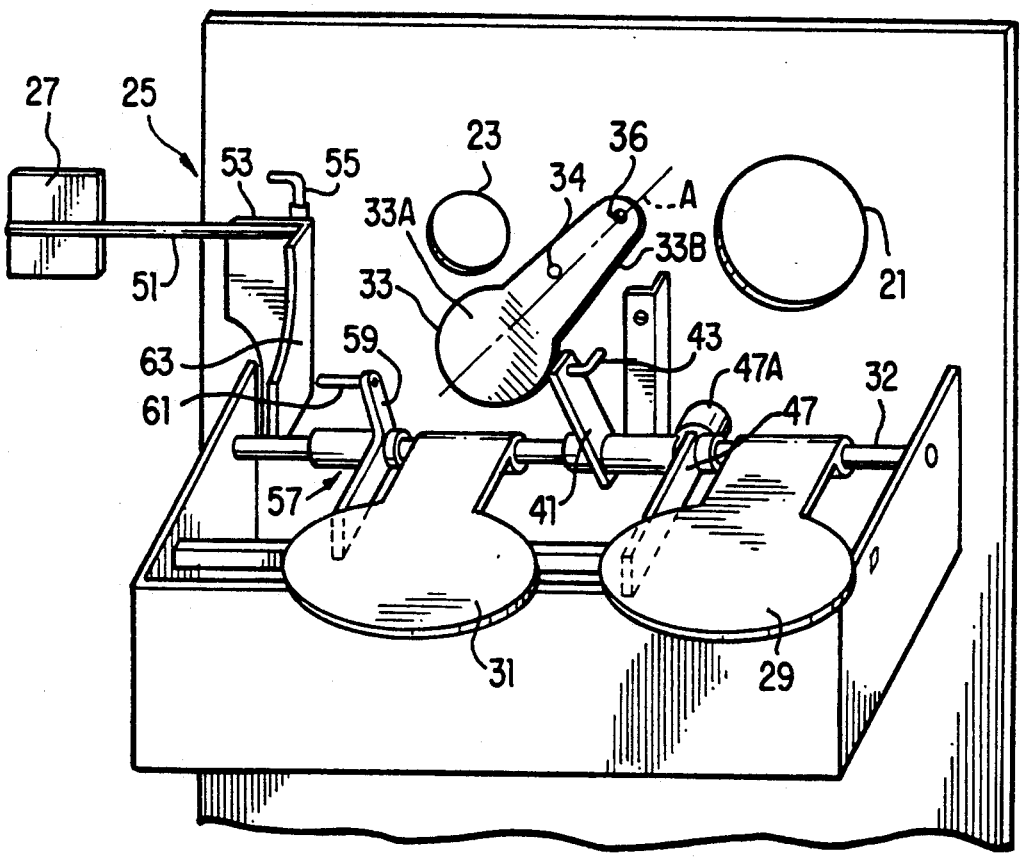

According to the embodiment illustrated by FIGS. 3A–3C, the target protector plate mechanism 35 comprises a first member 41 pivotally mounted to the main shaft 32 for movement between a hold position (FIG. 3A) and a release position (FIGS. 3B–3C). At a distal end of the first member 41, a holding pin 43 is attached for engaging the hole 36 in the target protector plate 33 when the first member 41 is at the hold position and the target protector plate 33 is at the first position (FIG. 3A).

The target protector plate mechanism 35 further includes a second member 47, rigidly attached to the first member 31, the second member being positioned adjacent to the primary target 29 so that, when the primary target 29 is struck and moves from the ready position to the scoring position, the primary target 29 strikes the second member 47 so as to pivot the first member 41 away from the back surface 30 of the face plate 17. As a result, the first member 41 is knocked from the hold position to the release position thereby withdrawing the holding pin 42 from the hole 36 in the shank 33B of the protector plate 33 and releasing the protector plate 33 from the first position. In order prevent the unintentional pivoting of the second member 47, a suitable counter weight 47A, for example, is provided to set the amount of force needed to pivot this second member 47.

The operation and structure of the signal means 25, of the present invention, will now be discussed with particular reference to the embodiment illustrated by FIGS. 3A-3C. While the following discussion will be with regard to the combination target, is should be clear to the skilled artisan that the signal means is also applicable to single as well as multiple target arrangements.

As best seen in FIG. 3A, the signal means 25 comprises the signal flag 27 mounted by a flag shaft 51 to a segment of angle iron 53 pivotally mounted to a substantially vertical pivot axis 55 which is best seen in FIG. 3C. The segment of angle iron 53 is mounted on the pivot axis 55 with some play so as to be also movable along the substantially vertical pivot axis 55.

The secondary target 31 (or a single target) is position adjacent to the signal means 25 and is provided with a holding pin 50 which holds the segment of angle iron 53 so that the signal means 25 maintains the hidden position when the secondary target 31 is in the ready position, as shown in FIGS. 3A-3B, to prevent the unintentional deployment of the signal means 25.

Also included is a trigger means, generally indicated at 57, which moves the signal means 25 to the signalling position (FIGS. 2A and 3C) as the secondary target 31 falls to the scoring position. The trigger means 57 comprises a trigger shaft 59 rigidly attached to the secondary target 31 for pivotal movement with the secondary target 31 about the main shaft 32.

The trigger shaft 59 is spaced from the angle iron 53 when the signal means 25 is in the hidden position (FIG. 3A) and the trigger shaft 59 engages a bottom edge of the segment of angle iron 53 only after the secondary target 31 is hit by a projectile and is committed, by gravity, to fall to the scoring position. The trigger shaft 59 also includes a trigger pin 61 at a distal end thereof for engaging a side 63 of the segment of angle iron 53 (as best seen in FIG. 3C) as the trigger shaft 59 is pivoted with the secondary target 31 during movement thereof from the ready to the scoring position. Once the signal means 25 has assumed the signalling position, the trigger pin 61 further functions to hold the signal means 25 at the signalling position and prevent the return of the signal mean 25 to the hidden position.

The signal means 25 operates as described below. When the secondary target 31 is struck and is committed, by gravity, to fall to the scoring position, i.e., has reached an unstable position which results in the toppling of the target, the trigger shaft 59 first lifts and then pivots the segment of angle iron 53. As the secondary target 31 continues to move towards the scoring position, the trigger pin 61 engages the side 63 of the angle iron 53 and continues to pivot the segment of angle iron 53 until the signal means 25 occupies the signalling position as shown in FIG. 3C. Thereafter, the signal means is held at the signalling position by the trigger pin 61.

Figure 4:
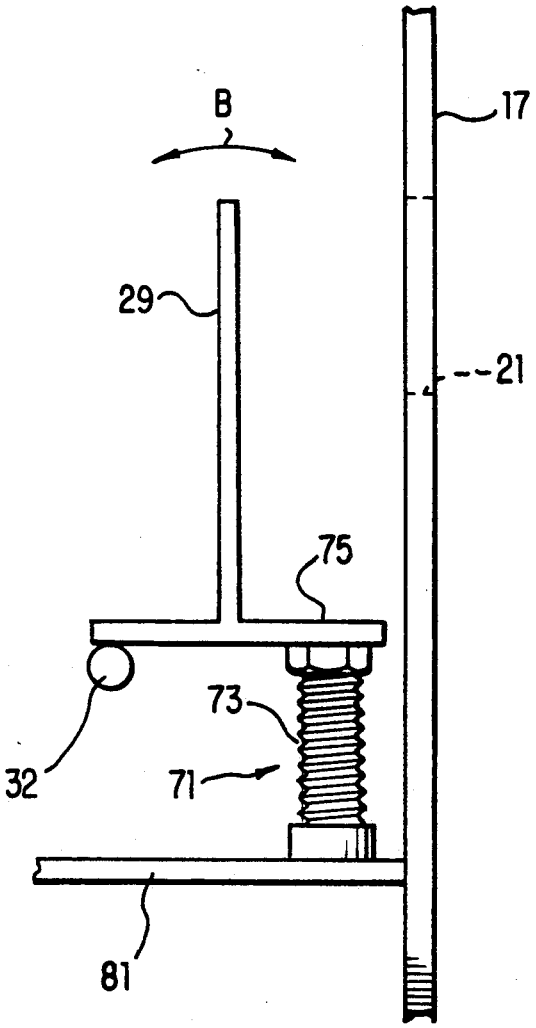
FIG. 4 is a side view, partially in section, illustrating an adjustment arrangement for adjusting the ready position of a primary or secondary target.

According to an advantageous feature of the present invention, an adjustment means, generally indicated at 71 in FIG. 4, is provided for adjusting the substantially vertical position of a target at the ready position. The adjustment means 71 comprises a threaded member 73 which supports a bottom 75 of the target, which as illustrated in FIG. 4, is the primary target 29. The thread member 73 engages a nut 79 or the like attached to a support member 81. By threading the member 73 into or out of the nut 79, the substantially vertical position of the target 29 at the ready position adjacent to the aperture 21 can be varied in the directions of arrow B.

Referring to FIG. 3B, combination target 15 is further provided with limiting means, generally indicated at 91, for limiting the knock down position of the primary and secondary targets 29, 31 at the scoring position. The limiting means comprises a bar 93 on which the targets 29, 31 will rest in the knocked down, scoring position.

As is understood by those skilled in the art, it is preferred that the combination target of the present invention be made of a material which will stand up to repeated hits from high speed projectiles, such as for example, armor plating and other similar metal materials.

Although the present invention has been described with particular reference to its preferred embodiments, it should be understood that many variations and modifications will now be obvious to those skilled in that art, and it is preferred, therefore, that the scope of the invention be limited, not by the specific disclosure herein, but only by the appended claims.

What is claimed is:

1. A combination target comprising:

a face plate having a front surface, a back surface and at least first and second apertures;

a primary target positioned adjacent the back surface at the first aperture;

a secondary target positioned adjacent the back surface at the second aperture;

a target protector plate for protecting the secondary target from being struck by a projectile until the primary target has been knocked down by a projectile, the target protector plate being pivotally mounted so as to be movable, by gravity, from a first position covering the second aperture to a second position uncovering the second aperture;

a target protector plate mechanism for holding the target protector plate at the first position until the primary target has been knocked down by a projectile and for releasing the protector plate from the first position to uncover the second aperture when the primary target fallen; and signal means for signaling that both the primary and secondary targets have been struck, the signal means being movable between a hidden position and a signalling position.

2. A combination target according to claim 1, wherein the at least one first aperture is larger than the at least one second aperture.

3. A combination target according to claim 1, wherein the at least first and second apertures respectively comprise first and second sets of apertures, each set of apertures having a different size.

4. A combination target according to claim 1, wherein both the primary and secondary targets are pivotally mounted on a main shaft for movement between a substantially vertical, ready position and a knocked down, scoring position.

5. A combination target according to claim 4, wherein the target protector plate comprises a paddle shaped plate having a broad flattened blade for covering the second aperture and a shank extending therefrom, and wherein the protector plate is pivotally mounted at the back surface of face plate by a pivot axis.

6. A combination target according to claim 5, wherein the target protector plate mechanism comprises a first member pivotally mounted to the chain shaft for movement between a hold position and a release position, a holding pin, attached to the first member, for engaging a hole in the target protector plate when the first member is at the hold position and the target protector plate is at the first position, and a second member rigidly attached to the first member, wherein the second member of the target protector plate mechanism is positioned adjacent to the primary target so that, when the primary target is struck and falls from the ready position to the scoring position, the primary target strikes the second member so that the first member is pivoted from the hold position to the release position thereby withdrawing the holding pin from the hole in the protector plate and releasing the protector plate from the first position.

7. A combination target according to claim 6, wherein the signal means comprises a flag mounted by a flag shaft to a segment of angle iron which is pivotally mounted to a substantially vertical pivot axis, the segment of angle iron being also movable along the substantially vertical pivot axis, wherein the secondary target is position adjacent to the signal means and includes a trigger means which moves the signal means to the signal position when the secondary target is knocked down to the scoring position.

8. A combination target according to claim 7, wherein the trigger means comprises a trigger shaft rigidly attached to the secondary target for pivotal movement with the secondary target about the main shaft, wherein, when the signal means is in the hidden position, the trigger shaft engages a bottom edge of the segment of angle iron only after the secondary target is hit by a projectile and is committed, by gravity, to fall to the scoring position, wherein the trigger shaft has a trigger pin at a distal end thereof for engaging a side of the segment of angle iron as the trigger shaft is pivoted with the secondary target during movement thereof from the ready to the scoring position and wherein, when the secondary target is struck and is committed, by gravity, to fall to the scoring position, the trigger shaft first lifts and then pivots the segment of angle iron, and as the secondary target continues to move towards the scoring position, the trigger pin engages the side of the segment of angle iron and continues to pivot the segment of angle until the signal means occupies the signalling position.

9. A combination target according to claim 4, wherein each of the primary and secondary targets include means for adjusting the substantially vertical position of the primary and secondary targets at the ready position.

10. A combination target according to claim 4, wherein each of the primary and secondary targets include limiting means for limiting the knock down position of the primary and secondary targets at the scoring position.

11. A combination target according to claim 1, wherein the at least first and second apertures respectively comprise first and second sets of apertures, each set of apertures forming a zig zag pattern.

12. A target comprising:

a face plate having a front surface, a back surface and at least a first aperture;

a target positioned adjacent the back surface at the first aperture and pivotally mounted to a pivot shaft, the target being movable between a substantially vertical ready position and a knocked down, scoring position; and signal means for signaling that the target has been struck, the signal means being movable between a hidden position and a signalling position;

wherein the signal means comprises a flag mounted by a flag shaft to a segment of angle iron which is pivotally mounted to a substantially vertical pivot axis, the segment of angle iron being also movable along the substantially vertical pivot axis;

wherein the target is positioned adjacent to the signal means and includes a trigger means which moves the signal means to the signal position when the secondary target is knocked down to the scoring position;

wherein the trigger means comprises a trigger shaft rigidly attached to the target for pivotal movement with the target about the pivot shaft;

wherein, when the signal means is in the hidden position, the trigger shaft engages a bottom edge of the segment of angle iron only after the target is hit by a projectile and is committed, by gravity, to fall to the scoring position;

wherein the trigger shaft has a trigger pin at a distal end thereof for engaging a side of the segment of angle iron as the trigger shaft is pivoted with the target during movement thereof from the ready to the scoring position; and wherein, when the target is struck and is committed, by gravity, to fall to the scoring position, the trigger shaft first lifts and then pivots the segment of angle iron, and as the target continues to move towards the scoring position, the trigger pin engages the side of the segment of angle iron and continues to pivot the segment of angle until the signal means occupies the signalling position.

13. A target according to claim 12, wherein the at least first aperture comprises a first set of apertures, the set of apertures forming a zig zag pattern.

* * * * *